US005915814A

United States Patent [19]

Crews

[11] Patent Number: 5,915,814

[45] **Date of Patent: *Jun. 29, 1999**

[54] CYCLONIC DRYER

[75] Inventor: Richard S. Crews, Cerritos, Calif.

[73] Assignee: Hydrofuser Technologies, Inc., Newport Beach, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/697,827

[22] Filed: Aug. 30, 1996

[51] Int. Cl.[6] ..... F26B 17/12

[52] U.S. Cl. ..... 34/166; 34/168; 34/173

[58] Field of Search ..... 34/314, 322, 326, 34/327, 136, 137, 166, 167, 168, 173; 159/4.01; 110/224

[56] References Cited

U.S. PATENT DOCUMENTS

| | | | |
|---|---|---|---|
| 2,724,686 | 11/1955 | Nicholson | 34/168 |
| 3,766,661 | 10/1973 | Bayens et al. | 34/168 X |
| 4,052,255 | 10/1977 | Hackbarth et al. | 159/4.01 |
| 4,101,263 | 7/1978 | Lumpkin, Jr. | 34/363 X |

OTHER PUBLICATIONS

A set of Integrated Environmental Systems (IES) (a predecessor to Applicant) drawings, entitled Riverside Paper, 1993.

A set of Crews Evaporator & Drier Co. (a predecessor to Applicant) drawings, entitled National Nutrient, Drier and Grinder Prelim, Jun. 26, 1992.

*Primary Examiner*—Henry A. Bennett
*Assistant Examiner*—Steve Gravini
*Attorney, Agent, or Firm*—Lyon & Lyon LLP

[57] ABSTRACT

An improved cyclone dryer is disclosed, having an outer cylinder, an inner cylinder, and a cone-shaped chamber. The outer cylinder has a tangential airstream orifice for injecting a high-speed stream of material and air, or other gases, into the dryer. The inner cylinder has a plurality of apertures and a plurality of deflectors that deflect air and material into a cavity defined by the inner cylinder and the cone-shaped chamber. The cone-shaped chamber, the outer cylinder, and the inner cylinder define an annular air chamber. An exhaust assembly is attached proximate the inner and outer cylinders, and is in fluid communication with the cavity.

20 Claims, 5 Drawing Sheets

CYCLONIC DRYER

FIELD OF INVENTION

This application relates to the field of industrial drying equipment, particularly cyclonic dryers used for drying, among other things, paper pulp and industrial and municipal sludge.

BACKGROUND

Cyclonic chambers are well known in the art and have been used in many applications, such as in separating, comminuting, mixing, and drying materials. In isolation, a cyclone is a simple mechanical device that can accomplish the above-listed tasks by using the force of gravity, centrifugal forces and pressure differentials at various points. Generally, cyclone chambers (hereinafter also referred to merely as "cyclones") are formed at least partially in the shape of an inverted cone, with the base (largest diameter) of the cone generally on top. Depending on their dimensions, the cyclones may also be in the shape of an inverted frustum, which is generally a cone shape where the small, tapered end has been cut off parallel to the base. Because cone-shaped cyclones and frustum-shaped cyclones are operationally similar, reference will be made herein primarily to a cone-shaped cyclone.

Cyclones may come in a variety of configurations that are intended for different applications. For example, as shown in FIG. 1, a cyclone is shown having a body 10 that comprises an upper, cylindrical shaped portion 12, and a lower, cone-shaped portion 11. FIG. 1 is described in the *Handbook of Industrial Drying,* pp. 728–733, at FIG. 11 (2nd Edition, Arun S. Mujumdar, editor, 1995). The cyclone shown and described there has three orifices for dust particles and air to enter and exit the cyclone. In the application described therein, an airstream containing dust particles enters the cyclone at an airstream input orifice 13, at a high velocity in a direction tangential to a center axis 14. The velocity is high enough so that the entering airstream is forced against the outside wall of the cyclone due to centrifugal forces. Gravity forces denser material (dust particles in this illustration) to fall, thereby resulting in a circular, downward vortex, as shown at 15. Gravity forces the dust particles eventually to escape through a bottom orifice 16 of the cyclone.

At the same time, a circular vortex is created that draws air upward inside the cyclone. This upward vortex 17 carries air and other particles up and out through an exit orifice 18. A number of factors determine which particles escape through the bottom orifice 16 or through the exit orifice 18. Among these factors are the pressures at each of the orifices, the velocity of the entering airstream and the velocity of each of the vortexes, the size and density of particles, the dimensions of the cyclone, and the interior structure of the cyclone. Generally, particles are carried upward via the upward vortex 17 when buoyant forces overcome the gravitational forces.

A cyclone such as that described above may be used to dry a wet substance as the substance is passed through the cyclone. Various methods have been used to effect the drying of the substance. For example, a wet substance may be introduced through the same tangential port where the high velocity airstream enters the cyclone. The substance is dried as the high velocity air impacts individual particles of the substance. Often, the air is heated to effect more efficient drying. Alternatively, the wet substance could be inserted separately at a point near where the tangential air stream enters the orifice, so that the air immediately impacts the substance and forces the substance to flow in a circular vortex. Another similar drying method uses a variant on the cyclone chamber, and is commonly called a spray dryer. A spray dryer operates by reducing the material to be dried into small droplets, then subjecting those small droplets to a large amount of hot air, thereby supplying the heat necessary to evaporate the liquid.

None of these prior dryers are able to efficiently dry large volumes of sticky, pasty material, such as paper pulp and municipal sludge. One of the problems with the prior dryers is that the sticky and pasty materials tend to stick to the sides of the cyclone. A second problem with prior dryers is their limited ability to suspend the wet material or otherwise keep it in the cyclone for a sustained period of time in order to most efficiently dry the material, resulting in an inadequate resonance time (alternatively known as retention time). Because of their structure, such prior dryers are limited in their operating parameters, such as the velocity of the incoming airstream and material feed, the volume of air allowed into the dryers and the pressure applied at the various inlets, particularly the airstream inlet. A third problem is that, in order to create a tangential flow of air in prior dryers, the fans and or ducting supplying the air need to be oriented in such a manner as to create a tangential flow. This can cause problems when installing the dryers, because the site may have to be modified to allow for specialized fans and ducting. Also, prior dryers are not as efficient as they could be.

Current environmental regulations and space constraints make it desirable to be able to dry sludge, paper pulp, and other wet materials, prior to removing them from their source. The efficiency of prior dryers, however, often is not high enough to make their use economical. The cost of drying and removing the material is generally compared to the cost of simply transporting and dumping the wet material.

The prior art dryers often are inefficient because the air inside the cyclone, even if it is heated and spinning rapidly, can only affect a small part of the surface area of the substance to be dried. Often, the air and the material to be dried create a smooth flowing mass, with little turbulence. While this creates a smooth airflow, it does not promote optimum drying. Their design limits the amount of pressure and inlet velocity that can be used efficiently. While it may be possible for spray dryers to be adapted to handle sticky and pasty material, their inefficiency and reliability is a drawback.

SUMMARY OF THE INVENTION

The present invention provides an improvement on the forementioned dryers by creating an efficient apparatus and process for drying large quantities of sticky or pasty substances. Such substances include, among others, paper slurry that is left over from paper manufacturing, and municipal and industrial sludge. Some prior attempts at drying material with a cyclonic chamber, as described above, used high velocity air or other gases and forced the wet material to the outside diameter of the cyclone, due to centrifugal forces. The air and the wet material is then generally forced to swirl downward and outward, against an outer surface, as shown in FIG. 1 and described above. The present invention, however, introduces the air and wet material into an annular air chamber that is substantially separate from the cyclone cavity. The annular air chamber thus allows the wet material to be at least partially dried prior to entering the cyclone cavity and increases the retention time in the dryer. The improved dryer has an inner cylinder with deflectors to channel the flow of air and material into the cavity, deflecting small parts of the overall flow through individual apertures in the inner cylinder. Further, the improved dryer has a series of vanes that direct the air and material flow upward and create a turbulent flow within the cavity, thereby enhancing the efficiency of the dryer.

After passing through the apertures and into the cavity, the air and material eventually form a downward vortex, and an inner, upward vortex, similar to those of the prior art. The downward vortex is created due to centrifugal forces and gravitational forces, resulting in a generally circular and downward vortex. The upward vortex is created due to the shape of the cyclonic chamber. The downward vortex forces air and material into the lower portions of the cyclonic chamber, which is the smallest portion of the chamber. This results in the creation of a high pressure zone that forces the air upward, thereby creating a collapsing force in an upward direction. Momentum from the downward vortex makes the air and some of the lighter particles spin in the same direction about the cyclonic axis. The result is an inner, upward vortex about the center axis.

The intersection of the outer (downward) and inner (upward) vortexes creates a turbulent boundary layer. The preferred dryer additionally dries wet material by at least partially suspending the material in the boundary layer between the outer and inner vortexes. The material is suspended due to the countervailing forces acting on it. Centrifugal force and gravity act to push the material downward, yet the collapsing forces keep the material from immediately being forced to the outside and downward, effectively counteracting the centrifugal and gravitational forces. The time that the material is suspended in the cyclonic chamber is proportional to the rate of drying. The dimensions of the cyclonic chamber and the operating parameters can be varied to adjust the time that the material is suspended, with a resultant variation in the amount of drying.

The preferred dryer adds a number of other novel features to increase retention time and optimize drying efficiency. The various features each affect at least one of the performance factors such as pressure differential(s), speed of the airstream and material feed, temperature, and turbulence inside the dryer. The preferred dryer is also constructed so as to enable flexibility in configuring single or multiple dryers into systems for drying.

The preferred dryer may operate at a higher pressure differential than prior dryers. The preferred dryer may operate with a pressure of 10–30 inches of water at the air inlet, compared to a maximum of approximately 12 inches of water in existing dryers. The preferred dryer may also operate with greater material and air flow than the prior dryers, measured both in terms of quantity of flow and velocity. Further, the preferred dryer may be operated at geometric positions not used before, including varying body angles for the vacuum chamber.

Accordingly, it is an object of the present invention to provide an improved cyclonic dryer.

BRIEF DESCRIPTION OF THE DRAWINGS

These and other objects of the present invention will become better understood through a consideration of the following description taken in conjunction with the drawings in which.

DETAILED DESCRIPTION

Figure 1:
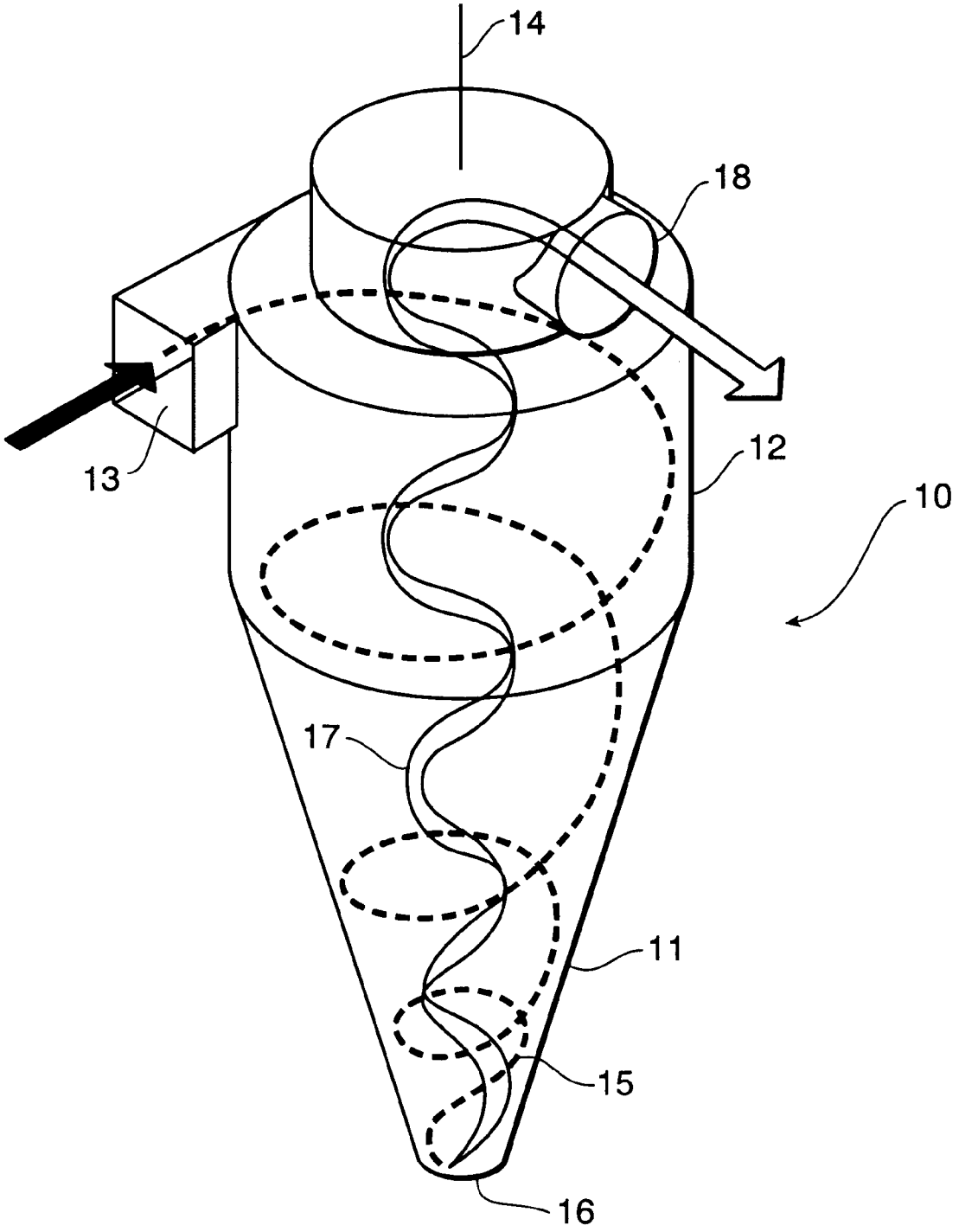
FIG. 1 (Prior Art)
FIG. 1 is a perspective view of a prior art cyclone, illustrating a flow of material through the cyclone.
Figure 2:
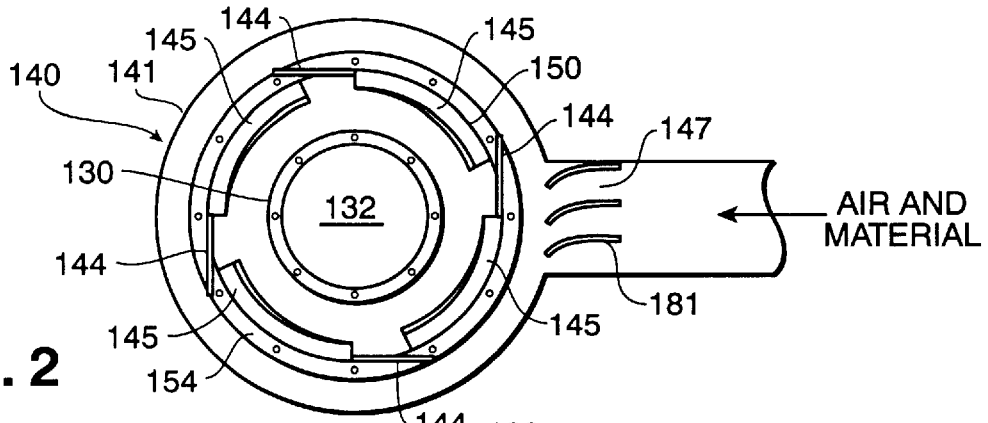
FIG. 2 is a perspective view of a preferred cyclone dryer according to the present invention, illustrating the major components and the flow of air and material through the cyclone.

Turning now to the drawings, FIG. 2 depicts a preferred cyclone dryer 120 for drying various sticky substances. The preferred dryer 120 comprises multiple interior structural elements which generally form a cavity 127. Viewed from the outside, the basic construction of a preferred cyclone chamber 121 is similar to those known in the art. For example, the cyclone body 10 described as representative of the prior art has an upper, cylindrical portion 12 and a lower, cone-shaped portion 11. A preferred outer cylinder 140 and cone-shaped chamber 160 are thus similar from the outside. For clarity, the preferred dryer 120 will be described in two general sections. First, the structure of the preferred embodiment will be described, followed by a description of the operation of the preferred embodiment. The structure will be described generally in the same sequence as the operation, beginning with the components related to the air inlet.

STRUCTURE OF THE PREFERRED EMBODIMENT

Turning now to the drawings, FIG. 2 illustrates a second preferred cyclone dryer 120 for drying various sticky substances. The preferred dryer 120 comprises a cyclone chamber 121 having a cone-shaped chamber 160, an outer cylinder 140, an inner cylinder 150, and an exhaust assembly 130, all of which are preferably in fluid communication with a cavity 127. Viewed from the outside, the basic construction of the second preferred cyclone chamber 121 is similar to the first preferred chamber 21 and others known in the art. For example, the cyclone body 10 described as representative of the prior art has an upper, cylindrical portion 12 and a lower, cone-shaped portion 11. Similarly, the preferred dryer 120 has an upper cylinder, described below as an outer cylinder 140, and has a cone-shaped chamber 160. However, the inner structure and the operation of the preferred dryer 120 are different from other dryers known in the art.

Preferably, a high velocity airstream enters the cyclone chamber at an airstream inlet orifice 147, generally proximate the outer cylinder 140. The preferred outer cylinder 140 comprises an outer surface 141 and a cap 155. The cap 155 is disk-shaped and attached to the top of the outer cylinder 141 and to a surface 151 of the inner cylinder 150. As shown in FIG. 2, the cap 155 may be oriented at a slight angle from the outer cylinder 140 to the inner cylinder 150. The lower edge of the outer cylinder 140 is attached to an upper surface 164 of the cone-shaped chamber 160. The cap 155 and the cone-shaped chamber 160 are preferably welded to the outer cylinder 140, forming seams as shown at 149 and 156.

Figure 3:
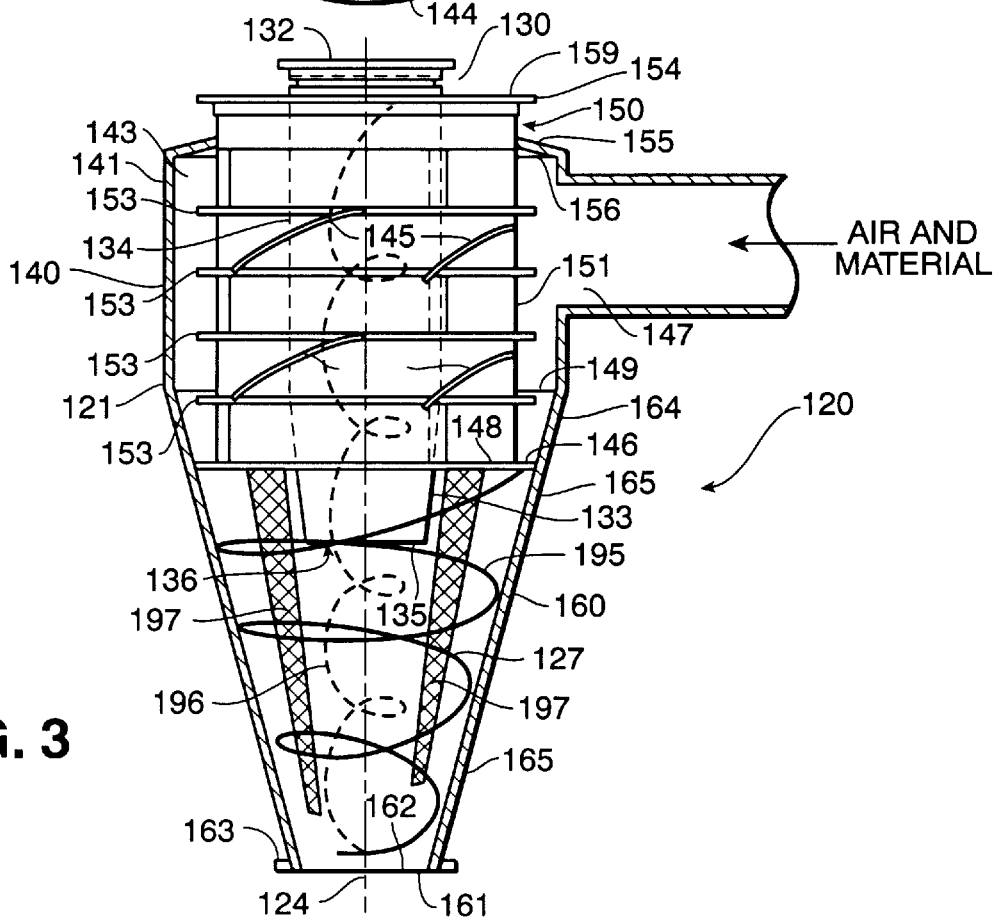
FIG. 3 is a top view of the preferred cyclone dryer shown in FIG. 2.
Figure 4:
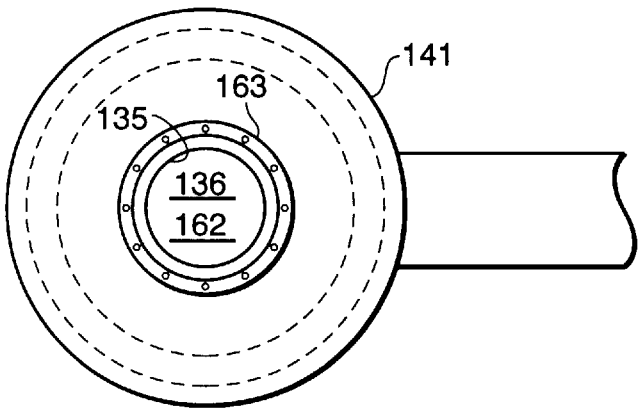
FIG. 4 is a bottom view of the preferred cyclone dryer shown in FIG. 2.
Figure 9:
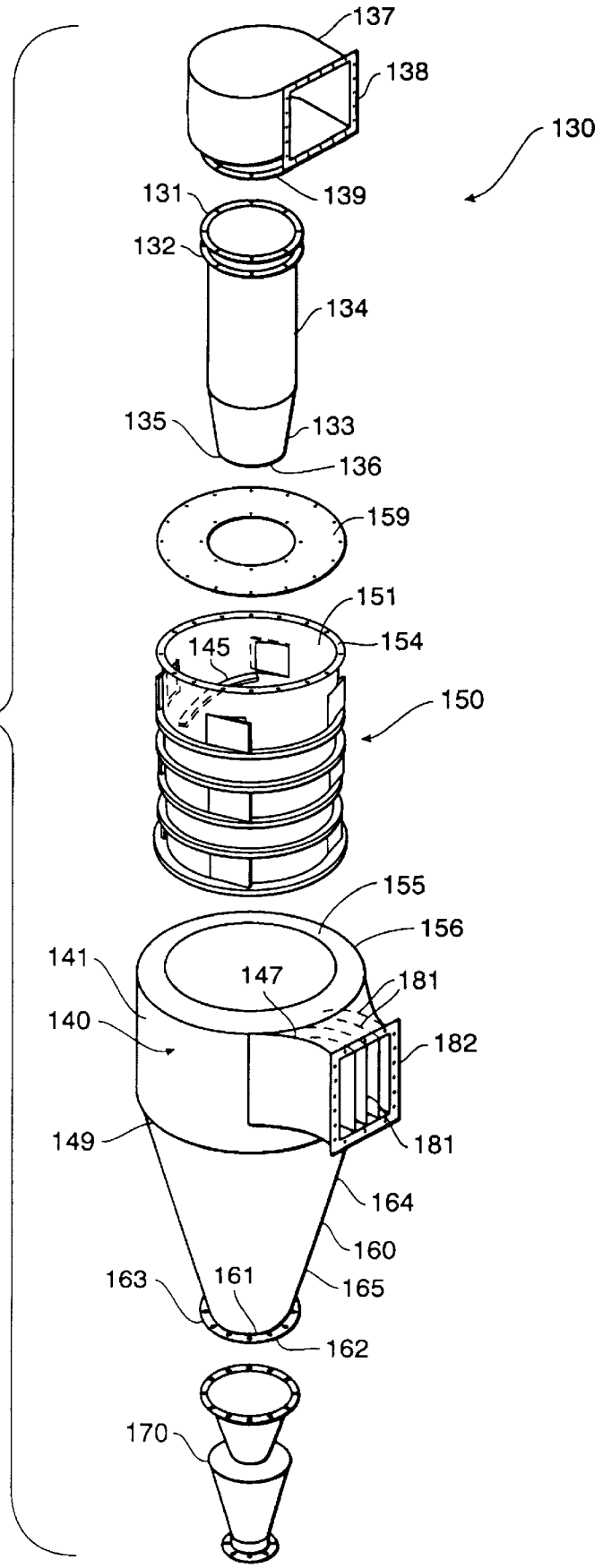
FIG. 9 is an exploded view of the preferred cyclone dryer according to the present invention, illustrating the major components and their structural relationships.

The inner cylinder 150, which is described in detail below, has a smaller diameter than the outer cylinder 140, and is preferably mounted inside the outer cylinder 140 and partially inside the cone-shaped chamber 160. The outer cylinder 140, the inner cylinder 150, and the cone-shaped chamber 160 all share the same axis 124. The bottom of the inner surface 151 is attached to a disk-shaped lower surface 146, preferably with a welded joint. The disk-shaped lower surface 146 is then preferably attached, via a welded joint, to the upper surface 164 of the cone-shaped chamber 160. The outer surface 141, the cap 155, the inner cylinder surface 151, the disk-shaped lower surface 146, and the upper surface 164 of the cone-shaped chamber 160, generally define a disk-shaped annular air chamber 143. The purpose of this chamber 143 is to allow for heated or ambient air (or gas or other fluids—reference hereinafter to air includes other gases) to be introduced into the cyclone chamber 121. The novel structure of the preferred embodiment allows flexibility in positioning the ducting and fans necessary to input air into the cyclone chamber 121. As shown in FIGS. 2, 3 and 9, air and material may be introduced into the annular air chamber 143 in a single port, as shown at the airstream inlet orifice 147. The inlet orifice 147 preferably has a collar 182 that is adapted to be connected to ducting or other means connected to the source of the air and material that is to enter the dryer 120. Preferably, curved vanes 181 are positioned in the inlet orifice 147 to direct the flow of air and material in a tangential direction. As shown in FIGS. 3 and 9, the vanes 181 are oriented to cause the air and material to flow in a clockwise direction. The vanes 181 alternatively could be oriented so as to direct the air and material in a counter-clockwise direction. Generally, the material to be dried comprises sludge or paper pulp, although other materials may be dried in the preferred embodiment. Reference hereinafter to "wet material" is intended to include sludge and paper pulp, and other material that has some threshold moisture content. Alternatively, the wet material may be input through a separate port, as long the wet material enters the annular air chamber 143 proximate the airstream inlet orifice 147.

The inner cylinder 150 is specifically shown in FIGS. 5–8. The inner surface 151 comprises the major structural element of the inner cylinder. The inner surface 151 is constructed of a flat sheet of metal, preferably steel, that is rolled into the shape of a cylinder. As partially shown in FIG. 6, there are twelve apertures 152 in the inner surface 151. The apertures 152 are lined up in four vertical columns, each column preferably having three apertures 152. Alternatively, the apertures 152 may be described as forming three rows, with four apertures 152 in each row. The number, spacing, and size of the apertures 152 can be varied based on the particular requirements in a particular situation. The apertures 152 allow air and material to pass from the annular air chamber 143 to the inner cavity 127.

Figure 6:
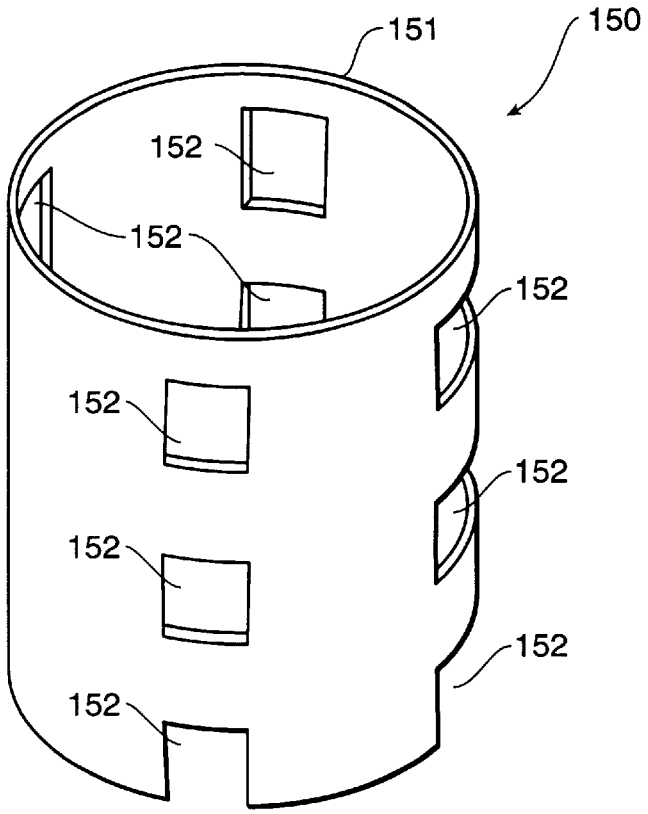
FIG. 6 is a perspective view of a preferred inner cylinder surface.
Figure 7:
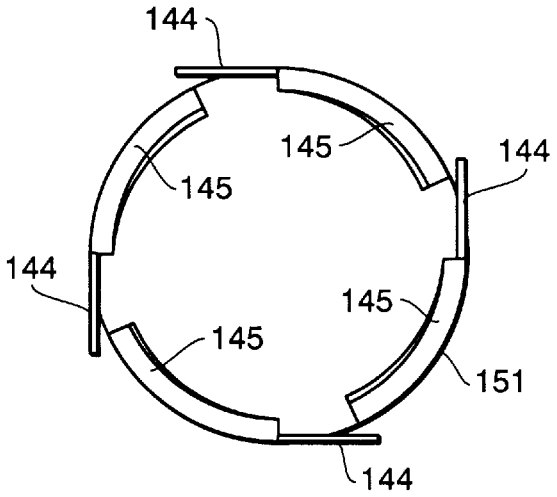
FIG. 7 is a top view of the preferred inner cylinder.
Figure 8:
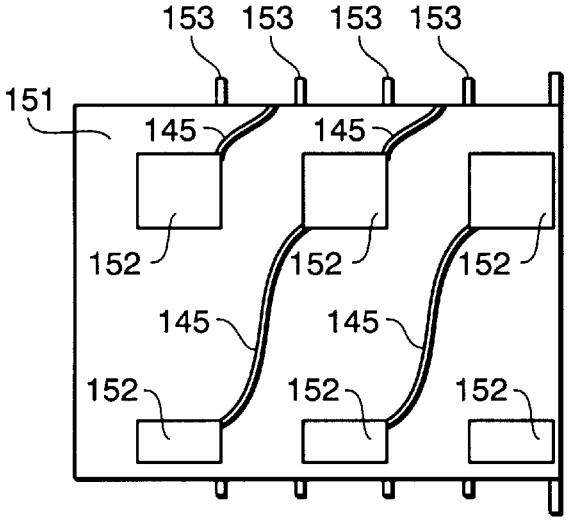
FIG. 8 is a side view of the preferred inner cylinder.

Additionally, the inner cylinder 150 may have a set of deflectors 144 mounted proximate individual apertures 152, and a set of ribs 153 mounted proximate individual rows of apertures 152. The deflectors 144 are oriented so that they "knife" into the annular air chamber 143 so as to divert some of the air and material that is spinning therein. The ribs 153 are disk-shaped and preferably are attached on the outside of the inner cylinder surface 151 and extend radially. As shown in FIG. 2, the ribs 153 extend only partially into the annular air chamber 143, so as to allow room for material to move downward and outward in the annular air chamber 143. The disk-shaped lower surface 146 is shaped similarly to the ribs 153, except that it extends radially further and contacts the surface of the cone-shaped chamber 160. Individual deflectors 144 are preferably attached to one side of each aperture 152, as shown in FIG. 6, and also attached to one or more ribs 153.

Preferably, there are four ribs 153 attached to the inner cylinder 150. The uppermost rib 153 is attached proximate the uppermost set of apertures 152. The bottom edges 157 of individual deflectors 144 are attached to individual ribs, for each of the top two rows of apertures 152 and deflectors 144. The top edges 158 of individual deflectors 144 are attached to individual ribs, for each of the bottom two rows of apertures 152 and deflectors 144.

Figure 5:
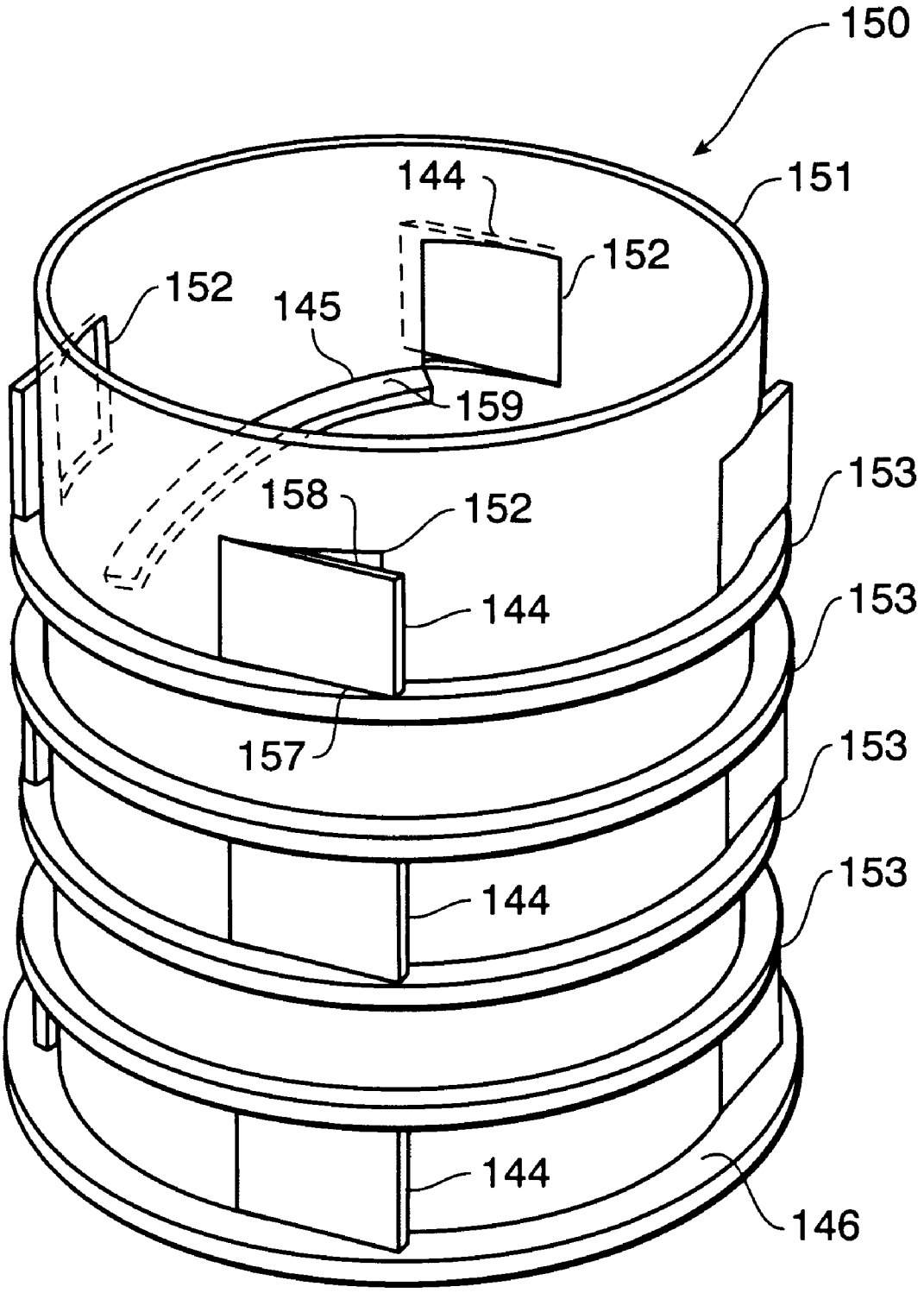
FIG. 5 is a perspective view of a preferred inner cylinder.

Vanes 145 are attached on the inside of the inner cylinder surface 151. Individual vanes 145 are constructed of generally flat members that are formed in the shape of partial disks that rotate about the center axis 124. Each vane 145 extends only partially around the circumference of the inner surface 151. Each vane 145 preferably extends at right angles inwardly from any adjacent point on the inner surface 151. From an axial perspective, the individual vanes 145 extend upwardly and clockwise. The actual length and upward progression of individual vanes 145 may vary according to specific applications. Preferably, each vane 145 extends axially a distance equal to the spacing between adjacent ribs 153 (see FIG. 8). As shown in FIG. 5, a pair of vanes 145 are sketched (partially in phantom), that extend from the second highest rib 153 to the bottom of the aperture 144 that is immediately above and in a clockwise direction from the origin of each vane 145.

As described above, a disk-shaped lower surface 146 is attached to the inner cylinder surface 151, as shown in FIG. 5. The lower surface 146 is also attached to the inside of the cone-shaped chamber 160, preferably by a welded seam. FIG. 9 shows an exploded view of the cyclone dryer 120, as it would appear prior to final assembly. The entire inner cylinder 150 may be lowered into the outer cylinder 140, and attached to the cone-shaped chamber 160.

The cone-shaped chamber 160 is a typical configuration for cyclones dryers, as is known in the art. The chamber 160 tapers from its largest circumference at the seam 149 proximate the upper surface 164, to its smallest circumference at the tip 161 proximate the lower surface 165. An output port 162 is formed at the tip 161, and has an output collar 163 which is generally used to connect other devices to the chamber 160. The preferred dryer 120 may have additional attachments thereon, as shown in FIG. 9. These attachments are generally known in the art and used for a variety of purposes. For instance, the configuration of the adapter 170 helps keep solid material from flowing out of the bottom of the dryer 120.

The exhaust assembly 130 preferably is mounted adjacent the inner cylinder 150. The preferred exhaust assembly 130 has a smaller diameter than the inner cylinder 150, and is mounted in the interior of the inner cylinder 150 in the cavity 127. The exhaust assembly 130 and the inner cylinder 150 share the same center axis 124. As shown in FIG. 9, the exhaust assembly 130 preferably comprises an exhaust cap 137 (the exhaust cap 137 is not shown in FIG. 2), a cylindrical middle portion 134, and a frustum-shaped lower portion 133. The frustum-shaped lower portion 133 has a circular bottom edge 135 that defines an opening 136. The opening 136 permits the exhaust assembly 130 to be in fluid communication with the cavity 127. The lower portion 133 is substantially located in the interior space defined by the cone-shaped chamber 160, as best shown in FIG. 2.

The lower portion 133 is preferably attached to the middle portion 134 via a welded joint. Two collars are preferably welded to the middle portion 134, and may be adapted for attachment of the middle portion 134 to other components. A lower collar 132 is attached proximate the top edge of the middle portion 134, and is adapted for attachment to a mounting disk 159. As shown in FIG. 9, the mounting disk 159 may be lowered on to an upper collar 154 of the inner cylinder 150. The outer edge of the mounting disk 159 preferably mates with the upper collar 154, and may be attached with screws, bolts, rivets, welding, or other means known in the art. The inner edge of the mounting disk 159 preferably also mates with the lower collar 132, and may be attached with screws, bolts, rivets, welding, or other means known in the art. When assembled, the majority of the middle portion 134 (below the lower collar 132) extends below the mounting disk 159.

An upper collar 131 is adapted for attachment to the exhaust cap 137, which has a cap collar 139. The upper collar 131 and the cap collar 139 preferably are similarly sized, and may be attached with screws, bolts, rivets, welding, or other means known in the art. When viewed from the top, the exhaust cap 137 is preferably substantially circular, with an exhaust port 138 extending tangentially from the outer surface of the cap 137, adapted to allow gases (or other material) to escape from the dryer 120. As shown in FIG. 9, the exhaust port 138 is oriented to allow gases to flow out of the dryer in a clockwise fashion. The orientation of the exhaust cap 137 would preferably be reversed in the event that the material in the dryer is oriented to flow in a counter-clockwise direction.

In order to create a lower pressure at the exhaust port 138, and thus enhance flow out of the port 138, the preferred cyclone dryer 120 may be attached to ducting attached to a fan, to help move air or material out of the dryer.

OPERATION OF THE PREFERRED EMBODIMENT

The preferred dryer works as described below. The preferred cyclone dryer 120 is constructed so as to create a downward, circular vortex, and then an upward, circular exhaust vortex. This is done in the following manner. First, an air stream containing a wet material that is to be dried is introduced into the annular air chamber 143. This air stream and the wet material are preferably injected tangentially, and at a high velocity, through the airstream inlet orifice 147 of the preferred dryer 120.

Prior to entering the dryer, the air and wet material are mixed, in ways known in the art. The preferred dryer does not require that the incoming air (or other gas) be heated.

The tangential flow of air and material is preferably created by injecting an airstream through the airstream inlet orifice 147, as shown in FIGS. 2, 3 and 9. The preferred airstream containing air and wet material is injected, using a static pressure at the inlet generally between 10–30 inches of water. Attached to the outer cylinder 140 at the airstream inlet orifice 147 is an air inlet duct that preferably provides heated air (or other fluid or gases) and wet material at a high velocity. Preferably, the preferred dryer is adapted to operate with an airstream that enters the airstream inlet orifice at 5,000–6,000 standard cubic feet per minute (SCFM), and at a velocity of 6,000 feet per minute. The preferred dryer is further adapted to operate at a range of 4,000–12,000 SCFM and at a velocity range of 3,000–6,000 feet per minute. For simplicity, the air flow containing wet material will sometimes be described herein simply as an air stream, although other fluids or gases may be considered to be included. A fan or other device for supplying the high velocity, tangential air stream is well known in the art and is not shown.

The air stream may enter the cyclone dryer 120 while the dryer 120 is set at a variety of angles. The curved vanes 181 and the airstream inlet orifice 147 channel the air stream into the annular air chamber 143. At that point, the airstream generally flows tangentially to the center axis 124 at a high rate of angular velocity. Use of the annular air chamber 143 eases the installation of the dryer 120 by allowing variability in the orientation of inlet ducting, fans, and other devices necessary to provide a high speed, tangential flow of air. It is thus possible, because of the annular air chamber 143, to position the airstream inlet orifice 147 at any location on the outer surface 141 of the outer cylinder 140. As shown in FIGS. 3 and 5–9, the structure of the preferred embodiment causes the air and material to flow in a clockwise direction. As illustrated in FIG. 2, the air would be flowing up and out of the page on the right side of the annular air chamber 143, and down, into the page on the left side of the annular air chamber 143. Alternatively, the airstream may be introduced in a counter-clockwise direction. If so, the flows described below would be reversed, and many of the structural components, such as the deflectors 144 and vanes 145 would need to be reversed.

The air and material swirls in a clockwise direction in the annular air chamber 143. In the preferred dryer 120, the only place where the air and material can escape from the annular air chamber 143 is through the apertures 152. In general, gravitational and centrifugal forces are acting on the air stream, forcing the air and material downward and outward. To aid in the movement of material through the preferred dryer, the deflectors 144 are attached to the outer surface 141 of the inner cylinder 150. The deflectors 144 act to deflect a portion of the tangential airstream, forcing part of the airstream into the cavity 127. As the air and material spin in the annular air chamber 143, the material naturally begins to separate and the heavier material is forced downward and outward. The preferred dryer is adapted to have enough energy to keep the material spinning, even while a layer of material is beginning to build up. As more and more material is added to the preferred dryer, the layer of material builds up, and is forced upwards and toward the inside. When the layer of material reaches far enough inwardly, the deflectors 144 "knife" into the spinning material and deflect a part of the material through the apertures 152 and into the cavity 127. Each individual deflector 144 reaches into the annular air chamber 143 and deflects a certain portion of the airstream and material. The air and material that passes individual deflectors continues in a generally downward and outward direction until it reached the disk-shaped lower surface 146, which defines the bottom of the annular air chamber 143. At this point, the air and material is either swept inward via the bottom row of deflectors 144 and apertures 152, or is forced to move in an upward direction. Any upward flow is resisted by the downward and outward flow created by the tangential air stream, so the majority of the remaining air and material is forced into the cavity 127 through the bottom row of apertures 152. The ribs 153 preferably restrict the vertical flow of material, so that the deflectors have an enhanced chance of diverting the air and material into the cavity 127. The preferred structure, whereby at least some of the deflectors 144 are attached to individual ribs, creates a funneling effect where air and material are channeled into the apertures 152.

Once the air and material passes through the apertures 152, it preferably continues rotating in a clockwise direction inside the cavity 127. Initially, the air and material rotates tangentially between the inner cylinder surface 151, and the sides of the middle exhaust portion 134 and the frustum lower portion 132 of the exhaust assembly 130. As above, gravitational and centrifugal forces continue to encourage a downward and outward flow. The vanes 145 located on the inner cylinder surface 151 are preferably shaped to direct some of the flow upward, resulting in turbulence within the cavity 127. Further, the preferred vanes 145 are constructed so as to end proximate individual apertures 152. This orientation forces air and material on the inside of the inner cylinder 150 which is directed upward and outward, to interact with the air and material that is passing through the apertures 152, which is generally moving inward and downward. The resulting turbulence, which is enhanced by this interaction, may be a positive phenomenon, because the turbulence tends to increase the retention time of the dryer. As is known in the art, the amount of drying is proportional to the time that a material is dried.

The air and material continue to spin tangentially and downward, past the bottom of the inner cylinder 150, through the orifice 148 formed between the frustum lower portion 133 of the exhaust 130, and the lower edge of the inner cylinder 150. This orifice 148 is part of the cavity 127. Due to the physical configuration of the cavity 127, the high-velocity air is forced to spiral downward and against the side of the lower, cone-shaped chamber 160, thereby creating a downward vortex 195, as shown by the swirling pattern in FIG. 2. Centrifugal forces make the air stream hug the sides of the cone-shaped chamber 160, thereby creating an area of low pressure in the center of the cavity 127. As the air approaches the output port 162, the cross-section of the cone-shaped chamber 160 gets smaller and smaller, which causes air to begin to swirl upward in the same rotational (angular) direction as the downward vortex 195. This results in the creation of a second vortex 196 (shown by the dashed lines in FIG. 2) that moves in an upward, circular direction proximate the center of the cavity 127. Air and other material in the upward vortex 196 are eventually carried through the cavity 127, then enter the exhaust assembly 130 and are expelled through the exhaust port 138.

An irregular boundary region is created between the downward vortex 195 and the upward vortex 196. The downward vortex 195 is situated generally within the outer parts of the cavity 127, the upward vortex 196 is located generally in the inner parts of the cavity 127, and the boundary region is shown as area 197, an irregular-shaped area generally existing between the two vortexes. This boundary region 197 is another region of turbulence that further enhances the efficiency of the preferred dryer, by keeping wet material suspended for a longer period of time.

Different pressures, flow rates, and temperatures may be used by one of skill in the art to further maximize the efficiency of the preferred dryer.

While embodiments of the present invention have been shown and described, various modifications may be made without departing from the scope of the present invention, and all such modifications and equivalents are intended to be covered.

I claim:

1. A cyclone dryer comprising an outer cylinder having an airstream orifice and a center axis, an inner cylinder mounted proximate said outer cylinder and said center axis and having a smaller diameter than said outer cylinder, said inner cylinder further having a plurality of apertures, a cone-shaped chamber attached proximate lower portions of said outer cylinder and said inner cylinder, said cone-shaped chamber, said cuter cylinder, and said inner cylinder defining an annular air chamber, said cone-shaped chamber and said inner cylinder defining a cyclone cavity communicating with said annular air chamber through said plurality of apertures, and an exhaust assembly attached proximate said inner cylinder and said outer cylinder, and in fluid communication with said cyclone cavity.

2. The cyclone dryer of claim 1, wherein said inner cylinder further comprises a plurality of deflectors mounted proximate said apertures.

3. The cyclone dryer of claim 1, wherein said inner cylinder further comprises a plurality of ribs mounted proximate said apertures.

4. The cyclone dryer of claim 1, wherein said inner cylinder further comprises a plurality of vanes mounted proximate said apertures.

5. The cyclone dryer of claim 1, wherein said inner cylinder further comprises a plurality of deflectors mounted proximate said apertures, a plurality of ribs mounted proximate said apertures, and a plurality of vanes mounted proximate said apertures.

6. The cyclone dryer of claim 1, wherein said annular air chamber is adapted for an incoming air and material stream having a flow of between 5,000 and 6,000 standard cubic feet per minute.

7. The cyclone dryer of claim 1, wherein said annular air chamber is adapted for an incoming air and material stream having a velocity of up to 6,000 feet per minute.

8. The cyclone dryer of claim 1, wherein said annular air chamber is adapted for an incoming air and material stream having a velocity of between 3,000 and 6,000 feet per minute.

9. The cyclone dryer of claim 1, wherein said annular air chamber is adapted for an incoming air and material stream having a flow of between 5,000 and 6,000 standard cubic feet per minute and a velocity of between 3,000 and 6,000 feet per minute.

10. The cyclone dryer of claim 1, wherein said annular air chamber is adapted for an incoming air and material stream having a flow of between 5,000 and 6,000 standard cubic feet per minute and a velocity of up to 6,000 feet per minute.

11. The cyclone dryer of claim 1, wherein said annular air chamber is adapted for an incoming airstream having an incoming pressure of between 10 and 30 inches of water.

12. The cyclone dryer of claim 1, wherein said annular air chamber is adapted for an incoming air and material stream having a flow of between 4,000 and 12,000 standard cubic feet per minute.

13. A cyclone dryer comprising an outer cylinder having an airstream orifice and a center axis, an inner cylinder mounted proximate said outer cylinder and said center axis and having a smaller diameter than said outer cylinder, said inner cylinder further having at least one aperture, a cone-shaped chamber attached proximate lower portions of said outer cylinder and said inner cylinder, said cone-shaped chamber, said outer cylinder, and said inner cylinder defining an annular air chamber, said cone-shaped chamber and said inner cylinder defining a cyclone cavity communicating with said annular air chamber through said plurality of apertures, and an exhaust assembly attached proximate said inner cylinder and said outer cylinder, and in fluid communication with said cyclone cavity.

14. A cyclone dryer, comprising an outer cylinder defining a center axis and including an airstream inlet orifice, an inner cylinder located substantially axially within the outer cylinder and thereby defining an annular air chamber between the inner and outer cylinders and at least partially defining a cyclone cavity within the inner cylinder, a plurality of apertures in the inner cylinder communicating between the cyclone cavity and the annular air chamber, a cone-shaped member extending axially from the outer cylinder and further defining the cyclone cavity therein, and an exhaust assembly attached to the outer cylinder and communicating with the cyclone cavity.

15. The cyclone dryer of claim 14, wherein the airstream inlet orifice communicates directly with the annular air chamber.

16. The cyclone dryer of claim 15, wherein the airstream inlet orifice is attached to the outer cylinder and has a configuration adapted to direct air entering the annular air stream from the airstream inlet orifice in a tangential direction.

17. The cyclone dryer of claim 14, further comprising a plurality of deflectors adjacent the plurality of apertures.

18. The cyclone dryer of claim 14, further comprising a plurality of vanes extending helically along the inner cylinder within the cyclone cavity.

19. The cyclone dryer of claim 14, further comprising a plurality of ribs extending radially within the annular air chamber.

20. The cyclone dryer of claim 14, further comprising a disk-shaped member extending between the inner and outer cylinders adjacent the cone-shaped member, and having a central opening therethrough.

* * * * *